United States Patent [19]

Liebert et al.

[11] Patent Number: 4,833,982

[45] Date of Patent: May 30, 1989

[54] PRINTING CYLINDER POSITIONING SYSTEM

[75] Inventors: Oskar Liebert, Neusäss; Klaus Theilacker, Friedberg; Johann Meitinger, Augsburg, all of Fed. Rep. of Germany

[73] Assignee: MAN Roland Druckmaschinen AG, Offenbach am Main, Fed. Rep. of Germany

[21] Appl. No.: 236,333

[22] Filed: Mar. 24, 1988

Related U.S. Application Data

[63] Continuation of Ser. No. 40,635, Apr. 21, 1987, abandoned.

[30] Foreign Application Priority Data

Apr. 25, 1986 [DE] Fed. Rep. of Germany ..... 3614027

[51] Int. Cl.[4] ..... B41F 7/10; B41F 7/12

[52] U.S. Cl. ..... 101/177; 101/182; 101/180; 101/247

[58] Field of Search ..... 101/177, 218, 178–180, 101/181, 182, 185, 137, 138, 139, 140, 140, 143, 144, 145, 247, 220, 221, 225

[56] References Cited

U.S. PATENT DOCUMENTS 4,218,972 8/1980 Fujishiro .

4,281,595 8/1981 Fusishiro ..... 101/177

4,369,705 1/1983 Gelinas ..... 101/177

FOREIGN PATENT DOCUMENTS 1158470 7/1969 United Kingdom .

*Primary Examiner*—J. Reed Fisher

*Attorney, Agent, or Firm*—Frishauf, Holtz, Goodman & Woodward

[57] ABSTRACT

To provide for selective printing by a five-cylinder printing machine either in single prism printing (1/0) or double prime printing (2/0) or prime-and-verso printing (1/1), at least one (3) of the printing cylinders can be selectively positioned by a crank arrangement (16, 15, 15*a*) which is coupled to a link (13) which link, in turn, operates a lever of an eccentric bearing (12) such that when the first printing cylinder (3) is to be, selectively, in engagement with either the impression cylinder (1) or the second blanket cylinder (2), the link is in a position at which the link passes through the axis of rotation of the crank so that reactive rotary forces from the blanket cylinder will not be transferred to the crank and hence will be isolated from an operating element (18) which moves the crank arrangement. Preferably, the crank arrangement is formed by a gear segment (15) which is rotated by a segmental gear (16), coupled to a linear piston—cylinder arrangement forming the operating element (18).

7 Claims, 4 Drawing Sheets

PRINTING CYLINDER POSITIONING SYSTEM

This application is a continuation of application Ser. No. 040,635, filed Apr. 21, 1987 now abandoned.

Reference to related applications, assigned to the assignee of the present application, the disclosures of which are hereby incorporated by reference:

U.S. Ser. No. 031,700, filed Mar. 27, 1987, FISCHER;

U.S. Ser. No. 035,616, filed Apr. 3, 1987, THEILACKER et al, now U.S. Pat. No. 4,753,168, issued June 28, 1988.

Reference to related publication: German Pat. No. 1,238,929 Bolza-Schunemann, assigned to Koenig & Bauer AG, to which British No. 1,158,470 corresponds.

The present invention relates to printing machinery, and more particularly to a positioning system for selectively positioning a printing cylinder, and especially a blanket cylinder of a rotary offset printing machine, in selected positions, in which, when the cylinder is engaged with another cylinder, special locking means to position the cylinder need not be provided.

BACKGROUND

Various types of printing machines, and especially five-cylinder printing machines, require selective positioning of a printing cylinder in more than one position. In five-cylinder printing machines, having two plate cylinder-blanket cylinder couples and an impression cylinder, it is frequently desired to selectively engage a blanket cylinder with another blanket cylinder or with the impression cylinder to provide, selectively, double prime or prime-and-verso printing Repositioning of printing cylinders is usually accomplished by retaining the shafts defining the centers of rotation of the printing cylinders in bearings which are located in bearing supports eccentric with respect to the shaft. Upon moving the bearing support, the position of the shaft, and hence of the cylinder with respect to another cylinder will be changed.

It has previously been proposed—see German Pat. No. 1,238,929 to which British No. 1,158,470 corresponds—to so support a rubber blanket cylinder of a five-cylinder printing machine such that the rubber blanket cylinder can either be engaged with another rubber blanket cylinder for two-color prime printing, also referred to as 2/0 printing or to engage that blanket cylinder with an impression cylinder for single color prime-and-verso printing, referred to as 1/1 printing. Change-over between the rubber or blanket positioning cylinder positions is carried out while the machine is stopped. The change-over mechanism is comparatively complex. In order to change over the position of the blanket cylinder, the machine is first stopped, and the plate cylinder is moved out-of-engagement with the blanket cylinder with which it forms a couple. Then a bolt coupling or clutch is released from an engaged position, a pinion and a crank arm together with a flanged bushing is then brought into an intermediate position, about 90° offset with respect to the initial position. The bolt is then engaged again, and an auxiliary drive is operated in order to move the blanket cylinder in the new position with the appropriate angular or rotary position to provide for engagement of the drive gear teeth against the impression cylinder, for example, from which it is driven. Thereafter, the coupling bolt is again released, the engagement movement further continued until the desired position is reached, and then the coupling bolt is again engaged in the third fixed and final position. Printing can be started only after a hydraulic cylinder controls the position of the respective blanket cylinder as desired, and, only then, can the machine be restarted.

The change-over, due to the dependence of the changed movement on the position of the engagement of the bolt on the one hand and the thus required release of the mechanism to engage and disengage the cylinder from the repositioning apparatus requires a considerable period of time, as well as skill and careful attention to monitor the position of the cylinders. The cylinders cannot be moved merely by hand, since they are steel elements which are very heavy.

THE INVENTION

It is an object to provide a positioning system for a rotary offset printing machine, and more particularly for a five-cylinder printing machine or the like, in which the change-over of the positioning of the printing cylinder is simple, and the required impression or printing pressure can easily be obtained by a single positioning element which is coupled to simple position changing elements.

Briefly, a single positioning element which, for example, is a hydraulic or compressed air cylinder, has three basic positions corresponding, respectively, to a position for double prime printing, prime-and-verso printing, and a removed position, in which the blanket cylinder is out of engagement with an opposed blanket cylinder or the impression cylinder so that, for example, the printing plate on the plate cylinder of the blanket cylinder—plate cylinder couple can be exchanged while the machine continues to print single-prime printing between another blanket cylinder and the impression cylinder. A link is provided to transfer rotary motion of an eccenter bushing retaining the blanket cylinder to the positioning element which includes arm or gear, for example a segmental gear, which is rotated by the crank positioning element. The link and the crank are so coupled together that the respective engaged positions of the blanket cylinder—against another blanket cylinder or against the impression cylinder—are 180° apart, and in each instance the axis of the link passes through the center of rotation of the crank or segmental gear. The axis of the link is to be considered as a theoretical line of the attachment point of the link to the crank, or gear segment, and to the eccenter bushing. Thus, no locking of the gear is needed since, in any one of the 180°—apart positions, two "on center" positions are provided for the link, in which no reactive rotary forces from the link can be transferred to the crank, and thus no significant transfer of forces which arise in the operation of the machine to the positioning element will result. The gear itself can be rotated by a second gear which is coupled to a linear positioning element, for example a hydraulic or pneumatic cylinder.

The system has the advantage that only a single positioning element is needed to change over a blanket cylinder between 2/0 printing and 1/1 printing. The hydraulic cylinder, preferably, is a dual cylinder-piston unit, located serially and connected to each other, to provide for three stroke positions: both pistons in both cylinders extended; neither piston in neither cylinder extended; and one piston in one cylinder extended whereas the other is in withdrawn position. Which one of the cylinders is extended becomes immaterial if both are the same size. This linear motion is then transferred in the form of rotary motion by connection of a segmental gear to a piston rod which, in turn, is in engagement with the gear which is rotated to position the link element which, in turn, positions the eccentric bushing retaining the bearing for the cylinder.

The arrangement can readily be constructed in form of an integrated system, insuring engagement and disengagement of the blanket cylinder with the respectively selected other cylinder—another blanket cylinder or the impression cylinder—with a minimum of structural requirements, and eliminating complex coupling, positive engagement and monitoring arrangements, and can also be so arranged that removal of the associated plate cylinder is not necessary. Rapid and reliable positioning of the blanket cylinder for the desired printing mode is thus obtained.

DRAWINGS

DETAILED DESCRIPTION

Figure 1:
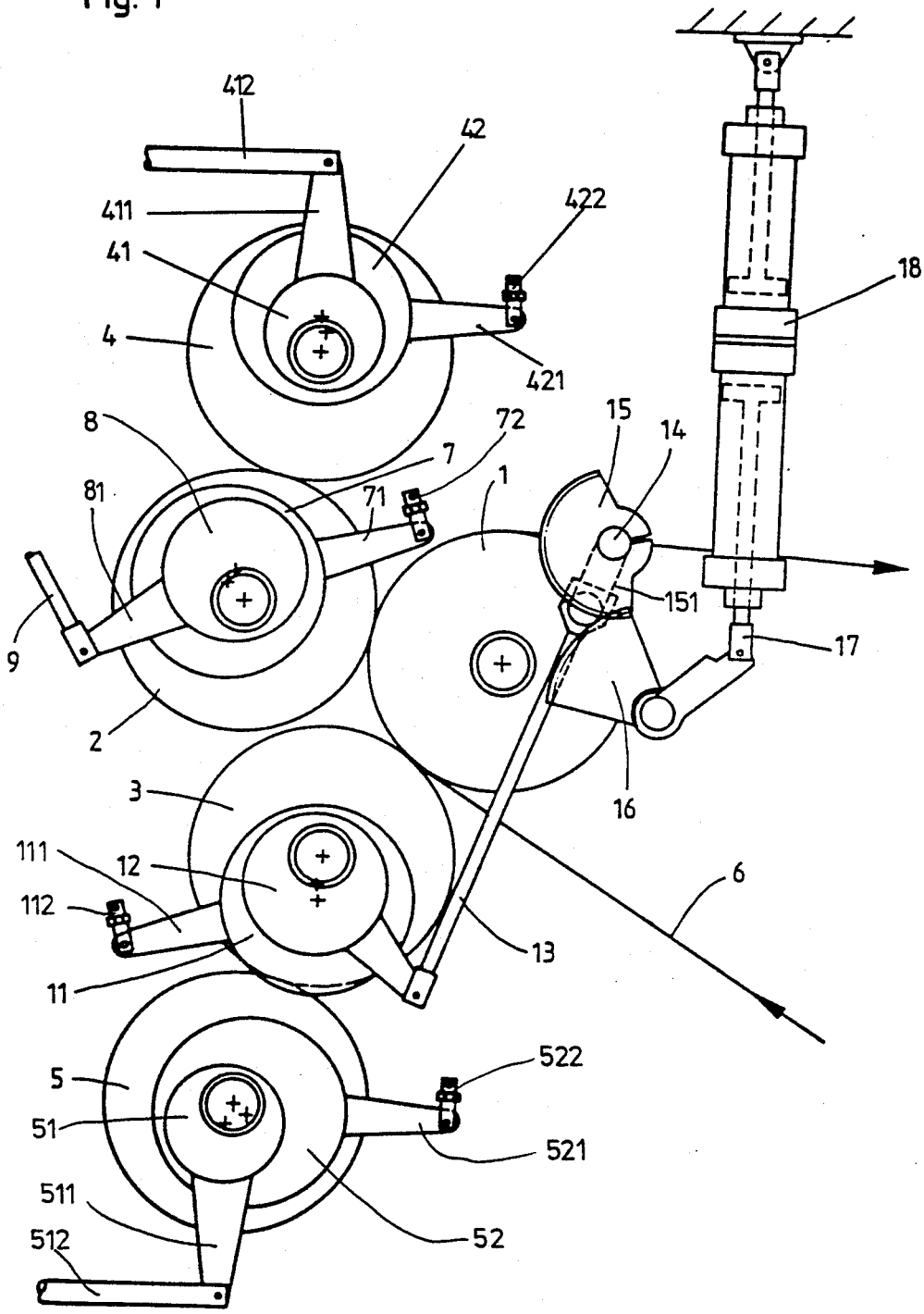
FIG. 1 is a highly schematic side view of the positioning system, when the printing machine system is arranged for double prime or 2/0 printing.
Figure 2:
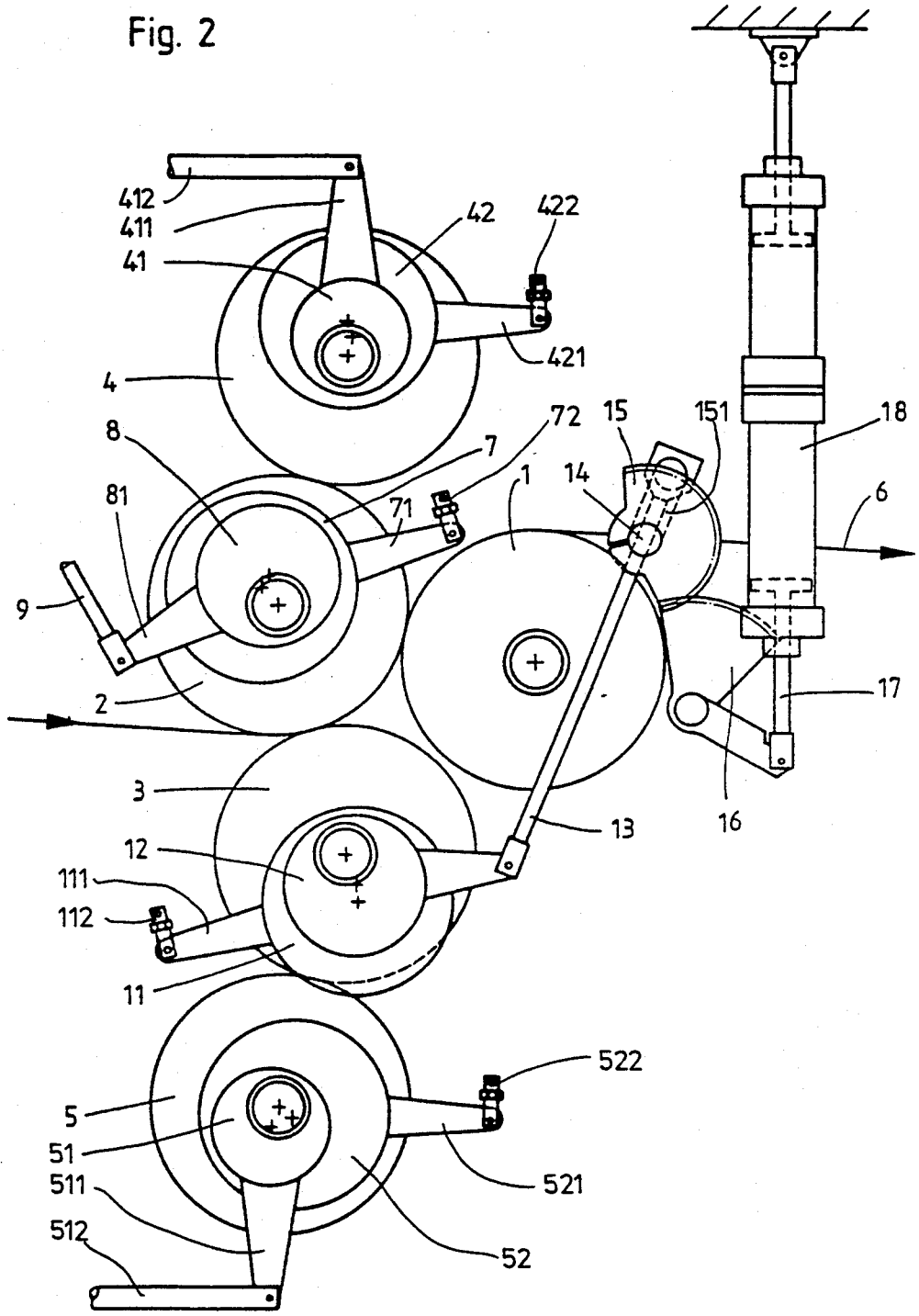
FIG. 2 is a view similar to FIG. 1, where the machine is arranged for prime-and-verso, 1/1, printing.

The invention will be illustrated in connection with a five-cylinder rotary web offset printing machine. A common impression or printing cylinder 1 is provided, which can receive printed subject matter from two blanket cylinders 2, 3, each of which has an associated coupled plate cylinder 4 and 5 in engagement therewith. Double prime or 2/0 printing, as illustrated in FIG. 1, requires that the two blanket cylinders 2, 3 are engaged against the common impression cylinder—with the web 6 therebetween. The web 6 is looped about the impression cylinder 1. Prime-and-verso, 1/1, printing—as illustrated in FIG. 2—is obtained by engaging the blanket cylinders 2, 3 against each other, with the web 6 now being passed between the blanket cylinders and about the impression cylinder 1, the depression cylinder 1 functioning then, for example, as a guide or paper web roller guide cylinder, if this is desired.

The bearing of the blanket cylinder 2 is retained in an eccenter bushing 7 which is coupled by a lever 71 and a rod 72 to a positioning system, not further shown, by which the appropriate printing pressure between the two blanket cylinders 2 and 3 for prime-and-verso printing may be pre-adjusted. A second eccenter bushing 8 is provided to move the cylinder 2 between engaged and disengaged position by moving of a link element 9 by a positioning element 10, shown schematically in FIG. 4 and more specifically explained hereinafter.

Blanket cylinder 3, the shaft end of which is shown by a small double circle with a center cross mark therein, is retained in an eccentric bushing 11 which is coupled by a lever 111 to a positioning system which, like the positioning system coupled to lever 71 of eccentric bushing 7, is well known and well known in printing machine technology, to obtain appropriate printing pressure between the respectively engaged cylinders. The cylinder 3 is actually journalled in the eccentric bushing 12—see FIG. 3—which is provided to selectively engage the blanket cylinder with the blanket cylinder 2 or with the impression cylinder 1, or to remove the blanket cylinder 3 from engagement with both the blanket cylinder 2 and the impression cylinder 1. The eccentric bushing 11 retains the eccentric bushing 12 in position within the side walls of the machine frame, shown only schematically in FIG. 3. In accordance with a feature of the invention, a link 13 is coupled to the eccentric bushing 12 which, at its other end, is connected to a gear 15, formed as a gear segment. Gear segment 15 is in engagement with a further gear segment 16 which is linked by a link system 17 to a three-position linear position element 18 having two units, placed in-line.

Figure 3:
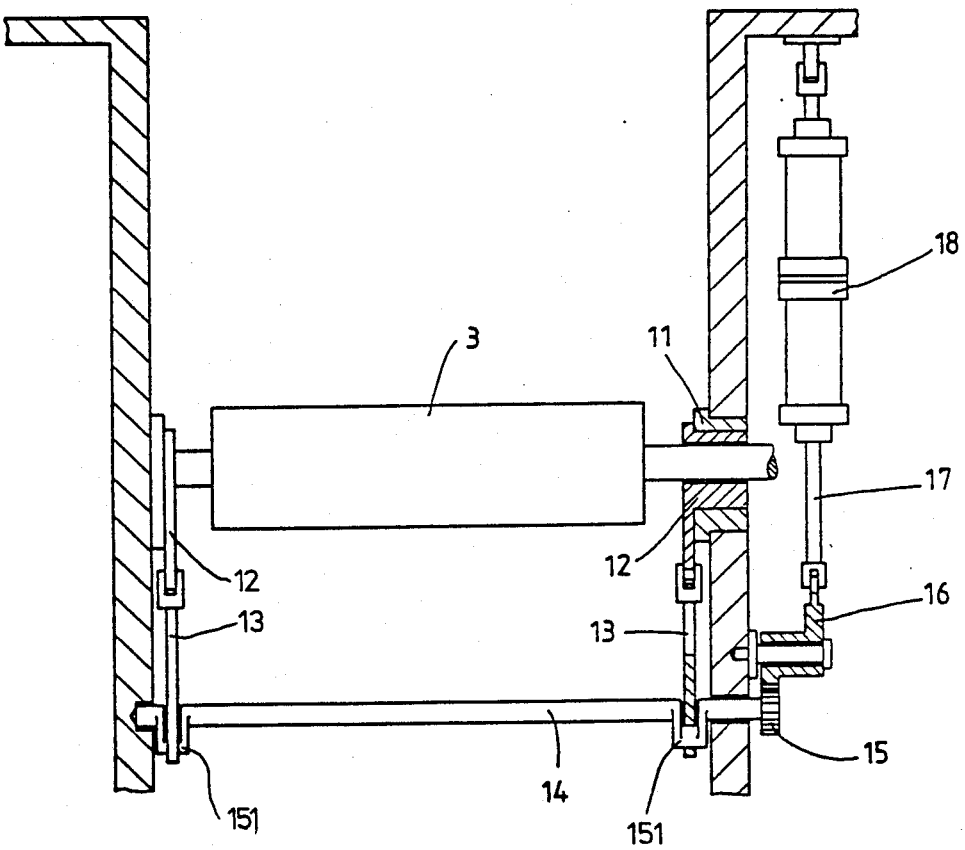
FIG. 3 is a schematic longitudinal section of the system, omitting all components not necessary for an understanding of the invention.
Figure 4:
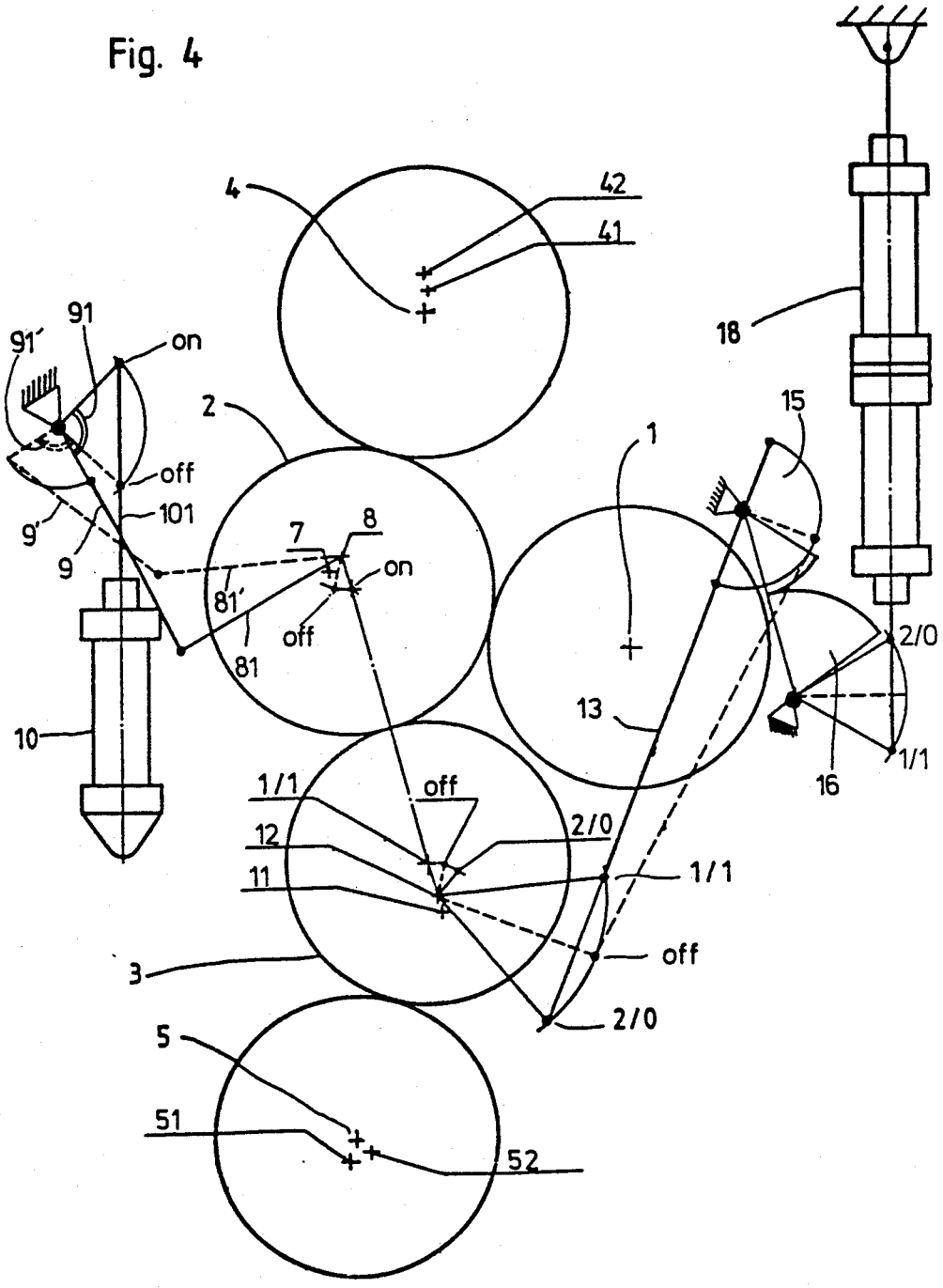
FIG. 4 is a kinematic diagram illustrating the relationship of the respective positioning elements and link elements.

Gear 15 rotates about a shaft 14—see FIG. 3—which couples a similar eccentric bushing-link arrangement at the left side, with respect to FIG. 3, to the cylinder 3. Only one positioning system formed by the gear 15, the connecting train 16, 17 and the positioning element 18 is needed on one side, the shaft 14 forming a synchronizing or coupling shaft. The link 13 need not be directly connected to the gear 15 but, rather, can be connected to a positioning crank 151 coupled to the shaft 14 which rotates with the gear segment 15, to permit suitable positioning of the respective elements adjacent the side walls of the machine, as seen in FIG. 3. The kinematic movement and force distribution, see FIG. 4, is not changed thereby.

FIG. 1 illustrates the position of the elements for dual-color, 2/0 prime printing. Both piston-cylinder arrangements of the positioning element, both units of the element 18, are in retracted position. The link 13, with respect to the center of rotation of the gear segment 15, and having an axis defined by the shaft 14, is in lower aligned position. As can be seen in FIGS. 1 and 4, a direct line can be connected between the pivot of link 13 to the eccentric coupling arm 12, the pivot point of the link 13 on the crank 151, and the center of shaft 14, and hence the center of rotation of gear 15. As can be seen, no rotary forces can be applied by the link 13 against the center of rotation of the shaft 14, and hence be transferred through the gear 15 to the positioning system 18. Forces which, therefore, may be transferred from the eccentric bushing 12 to the positioning system are essentially eliminated. Exceeding the alignment for a few degrees leads to a positive increase of assurance in the respective position.

Upon applying pressurized fluid to either one of the cylinders of the unit 18, gear 16 will be rotated which, due to the diameters of gears 15, 16, and preferably having a 2:1 gear ratio, causes rotation of gear 15 by 90°. The link 13 will, correspondingly, shift the eccentric bushing 12, and the blanket cylinder 3 will be placed in an intermediate position in which it neither touches the blanket cylinder 2 nor the impression cylinder 1. Since this is not a printing position for the cylinder 3, no force transfer from the cylinder 3 to the positioning element 12 will occur. Then the second blanket cylinder 2 can carry out printing in single color prime printing, that is, 1/0 printing, and the machine can operate while, for example, a plate on the plate cylinder 5 is exchanged. If the two piston-cylinder units of the element 18 are of the same size, it does not matter which one of the cylinders is extended.

FIG. 2 illustrates the position of the blanket cylinder 3 in the printing system for 1/1 or prime-and-verso printing. By extending both pistons of the dual cylinder—piston unit 18, gear 16 is rotated with repsect to the position shown in FIG. 1 such that gear 15 will rotate 180°. Consequently, the position shown in FIG. 2 will be reached. Again, link element 13 will be in aligned or stretched position—or a few degrees plus therefrom—so that, again, the axis of link 13 will pass through the center of rotation of the gear 15 and crank 151; hence forces which might be transferred from the eccentric bushing 12 to the gear 15 will not result in rotary displacement of the gear 15 and hence will be isolated from the positioning element 18.

The printing mode can be changed from 2/0 to 1/1, or vice versa, by simultaneously etending both positioning piston-cylinder units of the element 18, without any stop or intermediate position in which the cylinder 3 is stopped while being disengaged from both the cylinders 1 and 2.

Shaft 14 transfers the rotary movement to the other side of the machine. Positioning elements 15 through 18 thus are necessary only on one side of the machine. The rod 13, coupled to the crank 151, is provided on both sides of the machine, as seen in FIG. 3, from which all other cylinders have been omitted for clarity.

Either the upper printing couple 2/4 or the lower printing couple 3/5 may be used for respective printing, or both; a similar system including the eccentric bushing 8, lever 81, link 9, lever 91 and the positioning element 10 (FIG. 4) is coupled to the blanket cylinder 2 to provide an "on"—and an "off"—position of the blanket cylinder 2. The "off"—position is used for single prime printing (1/0) of the lower printing couple 3/5 if the cylinder 2 is placed out of engagement with blanket cylinder 3 and impression cylinder 1, for example for change of plate of the cylinder 4. The "on"—position is used for single prime printing (1/0) of the upper printing couple 2/4, for double prime printing (2/0) and also for prime-and-verso printing (1/1). As can be seen, the positioning elements 10 and 18 position the respectively coupled cylinders 2 and 3 separately from each other.

The positioning elements 10 and 18 may be pneumatic or compressed air cylinders, hydraulic cylinders or the like; other positioning elements for the gear 15 may be used, for example solenoid positioning or electric motor drives.

The gears 15, 16 are shown in FIGS. 1 and 2 as gear segments. Various changes and modifications may be made, for exammple the gears may be formed as full rotary gears or, alternatively, the shaft 14 with the crank arms 151 may be rotated by a sprocket chain, a gear belt, or the like, and turned in the respective rotary position such that the crank arm 151 coupled to the link 13 is in center-aligned or "dead center" position when the respectively coupled blanket cylinder is in printing engagement with another cylinder.

The plate cylinder 4 is journalled in two eccentric bearing bushings 41, 42. The bearing bushing 41, which is at the inside and surrounds the shaft end or stub shaft of the plate cylinder 4, is used to adjust diagonal register. Diagonal register adjustment is well known in the field in order to properly align cylinders which carry printing plates.

The outer bearing bushing 42 is used to set printing pressure or, alternatively, to preset printing pressure, which is the pressure applied by the plate cylinder on the blanket cylinder 2. The eccentric bearing bushings 41, 42 are securely coupled to, respectively, levers 411 and 421. At the other ends of the levers, positioning rods 412, 422, respectively, engage. The positioning rods 412, 422 are connected at their other ends—not shown in the drawing—to threads which, by engagement with a threaded bushing and retained in position on the frame of the machine, permit stepless precise rotation of the eccentric bearing bushings 41, 42.

Similarly, plate cylinder 5 is retained in two eccentric bearing bushings 51, 52 which can be rotated via levers 511, 521 and positioning rods 512, 522 for stepless adjustment. The inner bearing bushing 51 controls or adjusts diagonal register. The outer bearing bushing 52 presets the pressure with which the plate cylinder 5 engages the blanket cylinder 3.

The blanket cylinder 2 has its shaft end or stub shaft journalled in two eccentric bearing bushings 7 and 8. The inner bearing bushing 8 is used to engage or disengage the blanket cylinder 2 from the impression cylinder 1. The bearing bushing 8 is securely coupled to a lever 81 which, in turn, has an adjustment rod 9 pivoted thereon. Adjustment rod 9, as seen in FIG. 4, has its remote end connected to one leg of a rotatable angled lever 91. The other leg of the angled lever 91 is coupled to a piston rod 101, movable in a second positioning cylinder 10 between two positions. The solid lines shown in FIG. 4 show the position of the piston rod 101, the angled lever 91, the rod 9 and the lever 81 which places the cylinder 2 in the location shown in FIG. 2, that is, in which the blanket cylinder 2 is engaged on the impression cylinder 1. The levers illustrated in FIG. 4 in broken lines, and which have been given the same reference numerals with prime notation, correspond to a position of the blanket cylinder 2 in which it is off or removed from the impression cylinder 1. The end of the piston rod 101 is then in the position labeled "off" in FIG. 4.

The outer bearing bushing 7 can be rotated, steplessly, via a lever 71 and a positioning rod 72, similarly to the arrangement described in connection with levers 411, 412 and 421, 422, respectively. It presets the engagement pressure of the blanket cylinder 2 on the blanket cylinder 3 if prime-and-verso printing (1/1) is desired.

Similarly, rotating bearing bushing 11 of blanket cylinder 3 via positioning lever 111 and rod 112 permits presenting the printing pressure with which the blanket cylinder 3 can be engaged on the impression cylinder 1.

Presetting the impression pressures via the eccentric bearing bushings 42, 7, 11 and 52 is carried out usually only once; after presetting the engagement pressures, the positioning cylinders 10 and 18 can be operated in order to change over the positions of the blanket cylinders 2 and 3 for the different printing modes while, simultaneously, providing the necessary engagement pressures by the positioning cylinders. Thus, mere operation of the piston-cylinder arrangements 10, 101; 18, 17 permits change-over for the respective different printing modes.

The centers of the bearings bushings 7, 11, 42 and 53 which are used to preset the printing pressure are indicated by cross marks. The cylinders 4, 5 additionally show, by cross marks, the centers of the eccentric bearing bushings 41 and 51, which are used to adjust the diagonal registers. The eccentric bearing bushings 8 and 12 which are used to set the ON and OFF positions, respectively, of the blanket cylinders 2 and 3 are also shown by cross marks in the respective Figures. FIG. 4 further shows connecting lines, which are circular, which join dot or point marks representing the positions of the centers of the respective cylinders 2, 3 upon change-over between the various printing modes, and upon operation of the piston-cylinder units 10, 101 and 18, 17, respectively.

Various changes and modifications may be made within the scope of the inventive concept.

We claim:

1. Five-cylinder positioning system, for a multiple cylinder rotary offset printing machine system for applying printing on a substrate (6), selectively, in prime-and-verso printing, in double prime printing or in single prime printing, comprising an impression cylinder (1);

a first (3) and a second (2) blanket cylinder;

a first (5) and a second (4) printing cylinder, each associated with a respective blanket cylinder;

a first eccentric bearing (12) supporting said first blanket cylinder (3);

a second eccentric bearing (8) supporting said second blanket cylinder (2);

first positioning means (13, 18) coupled to the first eccentric bearing (12) and selectively positioning the first blanket cylinder (3) in any selected one of at least the following three positions:

(a) a first printing position, in which said first blanket cylinder (3) is engaged against said second blanket cylinder (2) to provide for prime-and-verso printing on the substrate, said substrate being passed between said blanket cylinders (2, 3), (b) a second printing position, in which said first blanket cylinder (3) is engaged against the impression cylinder (1) to provide single prime printing, or in combination with the second blanket cylinder (2) for double prime printing on the substrate (6), said substrate being passed between the impression cylinder and the respective first and second blanket cylinders (3, 2); and (c) a removed position, in which said first blanket cylinder (3) is removed from engagement with both the impression cylinder (1) and the second blanket cylinder (2), to permit exchange of a plate on the associated first plate cylinder (5) while the machine is operating and printing on the substrate (6) by means of the second blanket cylinder (2), second positioning means (9, 10) coupled to said second eccentric bearing (8) supporting the second blanket cylinder, separately positioning said second blanket cylinder (2); and said first positioning means comprising, in accordance with the invention, a single positioning element (18) having three positioning control positions corresponding to said first blanket cylinder positions (a), (b) and (c);

an unlocked, freely rotatable means (15), rotating about an axis of rotation (14);

means (16) for transferring motion of the single positioning element (18) to said rotatable means (15) to rotate said rotatable means;

link means (13) transferring rotary movement of the rotatable means to the eccentric bearing (12) to control the position of eccentricity thereof, comprising an essentially straight link element (13) having a link axis; and coupling means (151) for coupling said link element (13) to said rotatable means (15) at a position defining a crank arm, and located such that the link element (13) has a component of motion with respect to the axis of rotation of the rotatable means (15) which, upon rotation of said rotatable means through an angle of about 180° upon transfer of motion thereto by said motion transfer means (16) between a first (a) and a second (b) positioning control position of said single positioning element (18) corresponding to first blanket cylinder positions (a) and (b), places the link axis of said link element (13) at least approximately at an intersecting position with respect to the axis of rotation (14) of said rotatable means (15) when placing said first blanket cylinder (3) at either printing position (a) or (b), so that no relative rotary forces will be transferred from the eccentric bearing (12) to said rotatable means (15) and hence to the positioning element (18) due to the "dead center" positions of said link element with respect to said axis of rotation when the blanket cylinder is in either of the printing positions (a) or (b), said single positioning element (18) when in a third positioning control position (c) controlling rotation of said rotatable means (15) through an angle of about 90° to place said first blanket cylinder (3) in a position (c).

2. The system of claim 1, wherein said rotatable means comprises a gear means (15) rotating about said axis of rotation (14).

3. The system of claim 2, wherein said means for transferring motion of the positioning element comprises a gear (16) coupled to the positioning element (18).

4. The system of claim 3, wherein said gear (16) and said gear means (15) provide for a gear transmission ratio of about 1:2.

5. The system of claim 3, wherein said positioning element (18), said gear (16) and said gear means (15) comprises a kinematic chain which comprises a first gear segment (16) forming said gear, and extending about an angle of about 90°;

said gear means (15) comprises a second segmental gear extending about an angle of about 180° and in meshing engagement with said first segmental gear.

6. The system of claim 1, wherein said single positioning element (18) comprises two piston-cylinder arrangements positioned in-line with respect to each other.

7. The system of claim 1, wherein said single positioning element comprises an essentially linear piston-cylinder arrangement having three predetermined positioning control positions.

* * * * *